US006161770A

United States Patent [19]

Sturman

[11] Patent Number: 6,161,770

[45] Date of Patent: Dec. 19, 2000

[54] HYDRAULICALLY DRIVEN SPRINGLESS FUEL INJECTOR

[76] Inventor: Oded E. Sturman, One Innovation Way, Woodland Hills, Colo. 80863

[21] Appl. No.: 09/072,318

[22] Filed: May 4, 1998

Related U.S. Application Data

[63] Continuation-in-part of application No. 08/743,858, Nov. 5, 1996, which is a continuation of application No. 08/425,602, Apr. 20, 1995, abandoned, which is a continuation of application No. 08/254,271, Jun. 6, 1994, Pat. No. 5,460, 329.

[51] Int. Cl.[7] ..... F02M 47/02

[52] U.S. Cl. ..... 239/5; 239/88; 239/96

[58] Field of Search ..... 239/88, 89, 90, 239/91, 92, 95, 96, 5

[56] References Cited

U.S. PATENT DOCUMENTS

| | | |
|---|---|---|
| Re. 33,270 | 7/1990 | Beck et al. . |
| 892,191 | 6/1908 | Shuller . |
| 1,700,228 | 1/1929 | Kendall . |
| 2,144,862 | 1/1939 | Truxell, Jr. . |
| 2,421,329 | 5/1947 | Hoffer . |
| 2,434,586 | 1/1948 | Reynolds . |
| 2,535,937 | 12/1950 | Bozec et al. . |
| 2,552,445 | 5/1951 | Nielsen . |
| 2,597,952 | 5/1952 | Rosenlund . |
| 2,621,011 | 12/1952 | Smith . |
| 2,672,827 | 3/1954 | McGowen, Jr. . |
| 2,727,498 | 12/1955 | Reiners . |
| 2,749,181 | 6/1956 | Maxwell et al. . |
| 2,793,077 | 5/1957 | Bovard . |
| 2,912,010 | 11/1959 | Evans et al. . |
| 2,916,048 | 12/1959 | Gunkel . |
| 2,930,404 | 3/1960 | Kowalski et al. . |
| 2,934,090 | 4/1960 | Kenann et al. . |
| 2,945,513 | 7/1960 | Sampeitro . |
| 2,967,545 | 1/1961 | Schmidt . |
| 2,985,378 | 5/1961 | Falberg . |

(List continued on next page.)

FOREIGN PATENT DOCUMENTS

| | | |
|---|---|---|
| 0 149 598 A2 | 7/1985 | European Pat. Off. . |
| 0 184 940 A2 | 6/1986 | European Pat. Off. . |
| 0 331 198 A2 | 9/1989 | European Pat. Off. . |
| 0 375 944 A2 | 7/1990 | European Pat. Off. . |
| 0 425 236 A1 | 3/1991 | European Pat. Off. . |
| 0 245 373 B1 | 3/1992 | European Pat. Off. . |

(List continued on next page.)

OTHER PUBLICATIONS

North American Edition, Diesel Progress, Apr. 1997, Developments in Digital Valve Technology by Rob Wilson.

North American Editiion, Diesel Progress, Aug. 1997, Vickers Taking Closer Aim at Mobile Markets, by Mike Brezonick.

"The Swing to Cleaner, Smarter Hydraulics", Industrial Management & Technology, Fortune 152[A], Jan. 1997 by Stuart Brown.

(List continued on next page.)

*Primary Examiner*—Kevin Shaver
*Assistant Examiner*—David Deal
*Attorney, Agent, or Firm*—Blakely, Sokoloff, Taylor & Zafman LLP

[57] ABSTRACT

A fuel injector which has check valve that is hydraulically controlled by a control fluid. A volume of fuel is pressurized within a fuel chamber of the injector by an intensifier. The check valve controls the flow of fuel from the fuel chamber through at least one nozzle opening of a valve body. The flow of control fluid is controlled by a control valve which can move between a first position and a second position. When the control valve is at its first position, the control fluid creates an hydraulic force which moves the check valve to a closed position. When the control valve is at its second position, the control fluid moves the check valve to an open position to allow the pressurized fuel to be ejected or sprayed from the nozzle opening(s). The intensifier can also be hydraulically controlled by a control valve.

20 Claims, 5 Drawing Sheets

U.S. PATENT DOCUMENTS

| | | |
|---|---|---|
| 3,035,780 | 5/1962 | Peras . |
| 3,057,560 | 10/1962 | Campbell . |
| 3,071,714 | 1/1963 | Hadekel . |
| 3,175,771 | 3/1965 | Breting . |
| 3,368,791 | 2/1968 | Wells . |
| 3,391,871 | 7/1968 | Fleischer et al. . |
| 3,408,007 | 10/1968 | Raichle et al. . |
| 3,410,519 | 11/1968 | Evans . |
| 3,458,769 | 7/1969 | Stampfli . |
| 3,512,557 | 5/1970 | Weldy . |
| 3,532,121 | 10/1970 | Sturman . |
| 3,570,806 | 3/1971 | Sturman . |
| 3,570,807 | 3/1971 | Sturman . |
| 3,570,833 | 3/1971 | Sturman et al. . |
| 3,575,145 | 4/1971 | Steiger . |
| 3,585,547 | 6/1971 | Sturman . |
| 3,587,547 | 6/1971 | Hussey . |
| 3,604,959 | 9/1971 | Sturman . |
| 3,675,853 | 7/1972 | Lapera . |
| 3,683,239 | 8/1972 | Sturman . |
| 3,689,205 | 9/1972 | Links . |
| 3,718,159 | 2/1973 | Tennis . |
| 3,731,876 | 5/1973 | Showalter . |
| 3,743,898 | 7/1973 | Sturman . |
| 3,753,426 | 8/1973 | Lilley . |
| 3,753,547 | 8/1973 | Topham . |
| 3,796,205 | 3/1974 | Links et al. . |
| 3,814,376 | 6/1974 | Reinicke . |
| 3,821,967 | 7/1974 | Sturman et al. . |
| 3,827,409 | 8/1974 | O'Neill . |
| 3,835,829 | 9/1974 | Links . |
| 3,858,135 | 12/1974 | Gray . |
| 3,868,939 | 3/1975 | Friese et al. . |
| 3,921,604 | 11/1975 | Links . |
| 3,921,901 | 11/1975 | Woodman . |
| 3,989,066 | 11/1976 | Sturman et al. . |
| 3,995,652 | 12/1976 | Belart et al. . |
| 4,046,112 | 9/1977 | Deckard . |
| 4,064,855 | 12/1977 | Johnson . |
| 4,065,096 | 12/1977 | Frantz et al. . |
| 4,069,800 | 1/1978 | Kanda et al. . |
| 4,077,376 | 3/1978 | Thoma . |
| 4,080,942 | 3/1978 | Vincent et al. . |
| 4,083,498 | 4/1978 | Cavanagh et al. . |
| 4,087,736 | 5/1978 | Mori et al. . |
| 4,087,773 | 5/1978 | Jencks et al. . |
| 4,107,546 | 8/1978 | Sturman et al. . |
| 4,108,419 | 8/1978 | Sturman et al. . |
| 4,114,647 | 9/1978 | Sturman et al. . |
| 4,114,648 | 9/1978 | Nakajima et al. . |
| 4,120,456 | 10/1978 | Kimura et al. . |
| 4,152,676 | 5/1979 | Morgenthaler et al. . |
| 4,165,762 | 8/1979 | Acar . |
| 4,182,492 | 1/1980 | Albert et al. . |
| 4,189,816 | 2/1980 | Chalansonnet . |
| 4,192,466 | 3/1980 | Tanasawa et al. . |
| 4,217,862 | 8/1980 | Fort et al. . |
| 4,219,154 | 8/1980 | Luscomb . |
| 4,221,192 | 9/1980 | Badgley . |
| 4,231,525 | 11/1980 | Palma . |
| 4,246,876 | 1/1981 | Bouwkamp et al. . |
| 4,248,270 | 2/1981 | Ostrowski . |
| 4,260,333 | 4/1981 | Schillinger . |
| 4,266,727 | 5/1981 | Happel et al. . |
| 4,271,807 | 6/1981 | Links et al. . |
| 4,273,291 | 6/1981 | Muller . |
| 4,275,693 | 6/1981 | Leckie . |
| 4,279,385 | 7/1981 | Straubel et al. . |
| 4,308,891 | 1/1982 | Loup . |
| 4,319,609 | 3/1982 | Debrus . |
| 4,329,951 | 5/1982 | Seilly . |
| 4,342,443 | 8/1982 | Wakeman . |
| 4,346,681 | 8/1982 | Schleicher et al. . |
| 4,354,662 | 10/1982 | Thompson . |
| 4,372,272 | 2/1983 | Walter et al. . |
| 4,375,274 | 3/1983 | Thoma et al. . |
| 4,378,775 | 4/1983 | Straubel et al. . |
| 4,381,750 | 5/1983 | Funada . |
| 4,392,612 | 7/1983 | Deckard et al. . |
| 4,396,037 | 8/1983 | Wilcox . |
| 4,396,151 | 8/1983 | Kato et al. . |
| 4,405,082 | 9/1983 | Walter et al. . |
| 4,409,638 | 10/1983 | Sturman et al. . |
| 4,413,600 | 11/1983 | Yanagawa et al. . |
| 4,414,940 | 11/1983 | Loyd . |
| 4,422,424 | 12/1983 | Luscomb . |
| 4,425,894 | 1/1984 | Kato et al. . |
| 4,437,443 | 3/1984 | Hofbauer . |
| 4,440,132 | 4/1984 | Terada et al. . |
| 4,440,134 | 4/1984 | Nakao et al. . |
| 4,448,169 | 5/1984 | Badgley et al. . |
| 4,449,507 | 5/1984 | Mayer . |
| 4,457,282 | 7/1984 | Muramatsu et al. . |
| 4,459,959 | 7/1984 | Terada et al. . |
| 4,462,368 | 7/1984 | Funada . |
| 4,480,619 | 11/1984 | Igashira et al. . |
| 4,482,094 | 11/1984 | Knape . |
| 4,486,440 | 12/1984 | Carlson et al. . |
| 4,501,290 | 2/1985 | Sturman et al. . |
| 4,506,833 | 3/1985 | Yoneda et al. . |
| 4,516,600 | 5/1985 | Sturman et al. . |
| 4,518,147 | 5/1985 | Andresen et al. . |
| 4,526,145 | 7/1985 | Honma et al. . |
| 4,526,519 | 7/1985 | Mowbray et al. . |
| 4,527,738 | 7/1985 | Martin . |
| 4,540,126 | 9/1985 | Yoneda et al. . |
| 4,541,387 | 9/1985 | Morikawa . |
| 4,541,390 | 9/1985 | Steinbrenner et al. . |
| 4,541,454 | 9/1985 | Sturman et al. . |
| 4,550,875 | 11/1985 | Teerman et al. . |
| 4,554,896 | 11/1985 | Sougawa . |
| 4,557,685 | 12/1985 | Gellert . |
| 4,558,844 | 12/1985 | Donahue, Jr. . |
| 4,568,021 | 2/1986 | Deckard et al. . |
| 4,572,132 | 2/1986 | Piwonka . |
| 4,599,983 | 7/1986 | Omachi . |
| 4,603,671 | 8/1986 | Yoshinaga et al. . |
| 4,604,675 | 8/1986 | Pflederer . |
| 4,605,166 | 8/1986 | Kelly . |
| 4,610,428 | 9/1986 | Fox . |
| 4,611,632 | 9/1986 | Kolchinsky et al. . |
| 4,619,239 | 10/1986 | Wallenfang et al. . |
| 4,625,918 | 12/1986 | Funada et al. . |
| 4,627,571 | 12/1986 | Kato et al. . |
| 4,628,881 | 12/1986 | Beck et al. . |
| 4,648,580 | 3/1987 | Kuwano et al. . |
| 4,653,455 | 3/1987 | Eblen et al. . |
| 4,658,824 | 4/1987 | Scheibe . |
| 4,669,429 | 6/1987 | Nishida et al. . |
| 4,681,143 | 7/1987 | Sato et al. . |
| 4,684,067 | 8/1987 | Cotter et al. . |
| 4,699,103 | 10/1987 | Tsukahara et al. . |
| 4,702,212 | 10/1987 | Best et al. . |
| 4,715,541 | 12/1987 | Fruedenschuss et al. . |
| 4,719,885 | 1/1988 | Nagano et al. . |
| 4,721,253 | 1/1988 | Noguchi et al. . |
| 4,726,389 | 2/1988 | Minoura et al. . |
| 4,728,074 | 3/1988 | Igashira et al. . |
| 4,741,365 | 5/1988 | Van Ornum . |
| 4,741,478 | 5/1988 | Teerman et al. . |
| 4,753,416 | 6/1988 | Inagaki et al. . |
| 4,770,346 | 9/1988 | Kaczynski . |

4,785,787 11/1988 Riszk et al. .
4,787,412 11/1988 Wigmore et al. .
4,794,890 1/1989 Richeson, Jr. .
4,798,186 1/1989 Ganser .
4,807,812 2/1989 Renowden et al. .
4,811,221 3/1989 Sturman et al. .
4,812,884 3/1989 Mohler .
4,813,599 3/1989 Greiner et al. .
4,821,773 4/1989 Herion et al. .
4,825,842 5/1989 Steiger .
4,826,080 5/1989 Ganser .
4,831,989 5/1989 Haines .
4,838,230 6/1989 Matsuoka .
4,838,310 6/1989 Scott et al. .
4,841,936 6/1989 Takahashi .
4,869,218 9/1989 Fehlmann et al. .
4,869,429 9/1989 Brooks et al. .
4,870,939 10/1989 Ishikawa et al. .
4,875,499 10/1989 Fox .
4,877,187 10/1989 Daly .
4,884,545 12/1989 Mathis .
4,884,546 12/1989 Sogawa .
4,893,102 1/1990 Bauer .
4,893,652 1/1990 Nogle et al. .
4,905,120 2/1990 Grembowicz et al. .
4,909,440 3/1990 Mitsuyasu et al. .
4,922,878 5/1990 Shinogle et al. .
4,928,887 5/1990 Miettaux .
4,955,334 9/1990 Kawamura .
4,957,084 9/1990 Kramer et al. .
4,957,085 9/1990 Sverdlin .
4,964,571 10/1990 Taue et al. .
4,974,495 12/1990 Richeson, Jr. .
4,979,674 12/1990 Taira et al. .
4,993,637 2/1991 Kanesaka .
5,004,577 4/1991 Ward .
5,016,820 5/1991 Gaskell .
5,036,885 8/1991 Miura .
5,037,031 8/1991 Campbell et al. .
5,042,445 8/1991 Peters et al. .
5,048,488 9/1991 Bronkal .
5,049,971 9/1991 Krumm .
5,050,543 9/1991 Kawamura .
5,050,569 9/1991 Beunk et al. .
5,054,458 10/1991 Wechem et al. .
5,056,488 10/1991 Eckert .
5,067,658 11/1991 De Matthaeis et al. .
5,069,189 12/1991 Saito .
5,076,236 12/1991 Yu et al. .
5,085,193 2/1992 Morikawa .
5,092,039 3/1992 Gaskell .
5,094,215 3/1992 Gustafson .
5,108,070 4/1992 Tominaga .
5,110,087 5/1992 Studtmann et al. .
5,121,730 6/1992 Ausman et al. ..... 123/467
5,125,807 6/1992 Kohler et al. .
5,131,624 7/1992 Kreuter et al. .
5,133,386 7/1992 Magee .
5,143,291 9/1992 Grinsteiner .
5,156,132 10/1992 Iwanaga .
5,161,779 11/1992 Graner et al. .
5,168,855 12/1992 Stone .
5,176,115 1/1993 Campion .
5,178,359 1/1993 Stobbs et al. .
5,181,494 1/1993 Ausman et al. .
5,188,336 2/1993 Graner et al. .
5,191,867 3/1993 Glassey .
5,207,201 5/1993 Schlagmuller et al. .
5,213,083 5/1993 Glassey .
5,219,122 6/1993 Iwanaga .
5,237,976 8/1993 Lawrence et al. .
5,244,002 9/1993 Frederick .
5,245,970 9/1993 Iwaszkiewicz et al. .
5,249,603 10/1993 Byers, Jr. .
5,251,659 10/1993 Sturman et al. .
5,251,671 10/1993 Hiroki .
5,261,366 11/1993 Regueiro .
5,261,374 11/1993 Gronenberg et al. .
5,269,269 12/1993 Kreuter .
5,271,371 12/1993 Meints et al. .
5,287,829 2/1994 Rose .
5,287,838 2/1994 Wells .
5,293,551 3/1994 Perkins et al. .
5,297,523 3/1994 Hafner et al. .
5,313,924 5/1994 Regueiro .
5,325,834 7/1994 Ballheimer et al. .
5,339,777 8/1994 Cannon .
5,345,916 9/1994 Amann et al. .
5,346,673 9/1994 Althausen et al. .
5,357,912 10/1994 Barnes et al. .
5,375,576 12/1994 Ausman et al. .
5,410,994 5/1995 Schecter .
5,423,302 6/1995 Glassey .
5,423,484 6/1995 Zuo .
5,429,309 7/1995 Stockner .
5,445,129 8/1995 Barnes .
5,447,138 9/1995 Barnes .
5,460,329 10/1995 Sturman .
5,463,996 11/1995 Maley et al. .
5,477,828 12/1995 Barnes .
5,478,045 12/1995 Ausman et al. .
5,479,901 1/1996 Gibson et al. .
5,485,957 1/1996 Sturman .
5,487,368 1/1996 Bruning .
5,487,508 1/1996 Zuo .
5,492,098 2/1996 Hafner et al. .
5,492,099 2/1996 Maddock .
5,499,608 3/1996 Meister et al. .
5,499,609 3/1996 Evans et al. .
5,499,612 3/1996 Haughney et al. .
5,505,384 4/1996 Camplin .
5,509,391 4/1996 DeGroot .
5,515,829 5/1996 Wear et al. .
5,522,545 6/1996 Camplin et al. .
5,529,044 6/1996 Barnes et al. .
5,535,723 7/1996 Gibson et al. .
5,577,892 11/1996 Schittler et al. .
5,597,118 1/1997 Carter, Jr. et al. .
5,598,871 2/1997 Sturman et al. .
5,622,152 4/1997 Ishida .
5,632,444 5/1997 Camplin et al. .
5,638,781 6/1997 Sturman .
5,640,987 6/1997 Sturman .
5,641,148 6/1997 Pena et al. .
5,669,334 9/1997 Schönfeld et al. .
5,669,355 9/1997 Gibson et al. .
5,682,858 11/1997 Chen et al. .
5,697,342 12/1997 Anderson et al. .
5,720,318 2/1998 Nagarajan et al. .
5,823,429 10/1998 Beck et al. .
5,871,155 2/1999 Stockner et al. .
5,878,958 3/1999 Lambert .
6,026,785 2/2000 Zuo .

FOREIGN PATENT DOCUMENTS 892121 3/1962 Germany .
2 209 206 8/1973 Germany .
40 29 510 A1 3/1991 Germany .
41 18 236 A1 12/1991 Germany .
44 01 073 A1 7/1995 Germany .
195 23 337 A1 1/1996 Germany .
4-341653 11/1992 Japan .
981664 12/1982 Russian Federation .

| | | |
|---|---|---|
| 264710 | 10/1949 | Switzerland . |
| 2 308 175 | 9/1998 | United Kingdom . |
| WO 95/27865 | 10/1995 | WIPO . |
| WO 96/07820 | 3/1996 | WIPO . |
| WO 96/08656 | 3/1996 | WIPO . |
| WO 96/17167 | 6/1996 | WIPO . |
| WO 97/02423 | 1/1997 | WIPO . |

OTHER PUBLICATIONS

Electronic Unit Injectors–Revised, G. Frankl, G.G. Barker and C.T Timms, Copyright 1989 Society of Automotive Engineers, Inc.

SAE Technical Paper Series, Benefits of New Fuel Injection System Technology on Cold Startability of Diesel Engines—Improvement of Cold Startability and White Smoke Reduction by Means of Multi Injection with Common Rail Fuel System (ECD–U2), Isao Osuka et al., Feb. 28–Mar. 3, 1994.

SAE Technical Paper Series, Development of the HEUI Fuel System—Integration of Design, Simulation, Test and Manufacturing, A.R. Stockner, et al., Mar. 1–5, 1993.

SAE Technical Paper Series, "HEUI—A New Direction for Diesel Engine Fuel Systems," S.F. Glassey et al., Mar. 1–5, 1993.

Machine Design, Feb. 21, 1994, "Breakthrough in Digital Valves," Carol Sturman, Eddit Sturman.

Patent Specification No. 349,165, "Improved Electro–magnetic Double–acting Balanced Valve," Joseph Leslie Musgrave et al.

Patent Specification No. 1 465 283, Improvements in Fuel Injectors for Internal Combustion Engines, Seiji Suda et al., published Feb. 23, 1977.

Sturman Industries Gets Innovative All the Way!, The Bugle, Apr. 1993, vol. 19, Issue 4.

SuperFlow News, vol. 13, Spring 1998, "Sturman Tests Revolutionary Fuel Injectors".

HYDRAULICALLY DRIVEN SPRINGLESS FUEL INJECTOR

CROSS-REFERENCE TO RELATED APPLICATIONS

This application is a continuation-in-part of application Ser. No. 08/743,858, filed Nov. 5, 1996, which is a continuation of application Ser. No. 08/425,602, filed Apr. 20, 1995, abandoned, which in turn is a continuation of application Ser. No. 08/254,271, filed Jun. 6, 1994, now U.S. Pat. No. 5,460,329.

BACKGROUND OF THE INVENTION

1. Field of the Invention

The present invention relates to a fuel injector for internal combustion engines.

2. Background Information

Fuel injectors are used to introduce pressurized fuel into the combustion chamber of an internal combustion engine. FIG. 1 shows a fuel injection system 10 of the prior art. The injection system includes a nozzle 12 that communicates with a fuel inlet port 14 through an intensifier chamber 16. The intensifier chamber 16 contains an intensifier piston 18 which reduces the volume of the chamber 16 and increases the pressure of the fuel therein. The pressurized fuel is released into a combustion chamber of an engine through the nozzle 12.

The intensifier piston 18 is moved by a working fluid that is controlled by a poppet valve 20. The working fluid enters the fuel injector through inlet port 22. The poppet valve 20 is coupled to a solenoid 24 which can be selectively energized to pull the valve 20 into an open position. As shown in FIG. 2, when the solenoid 24 opens the poppet valve 20, the working fluid applies a pressure to the intensifier piston 18. The pressure of the working fluid moves the piston 18 and pressurizes the fuel. When the solenoid 24 is de-energized, mechanical springs 26 and 28 return the poppet valve 20 and the intensifier piston 18 back to their original positions. Spring 30 returns a needle valve 32 to a closed position to close the nozzle 12.

Fuel injectors having mechanical return springs are relatively slow because of the slow response time of the return springs. Additionally, the spring rate of the poppet spring generates an additional force which must be overcome by the solenoid. Consequently the solenoid must be provided with enough current to overcome the spring force and the inertia of the valve. Higher currents generate additional heat which degrades the life and performance of the solenoid. Furthermore, the spring rate of the springs may change over time because of creep and fatigue. The change in spring rate will create varying results over the life of the injector. It would be desirable to provide a fuel injector which does not have any mechanical return springs.

SUMMARY OF THE INVENTION

One embodiment of the present invention is a fuel injector which has check valve that is hydraulically controlled by a control fluid. A volume of fuel is pressurized within a fuel chamber of the injector by an intensifier. The check valve controls the flow of fuel from the fuel chamber through a nozzle opening of a valve body. The flow of control fluid is controlled by a control valve which can move between a first position and a second position. When the control valve is at its first position, the control fluid creates an hydraulic force which moves the check valve to a closed position. When the control valve is at the second position, the control fluid moves the check valve to an open position.

DETAILED DESCRIPTION OF THE INVENTION

One embodiment of the present invention is a fuel injector which has check or needle valve that is hydraulically controlled by a control fluid. A volume of fuel is pressurized within a fuel chamber of the injector by an intensifier. The check valve controls the flow of fuel from the fuel chamber through one or more nozzle openings of a valve body. The flow of control fluid is controlled by a control valve which can move between a first position and a second position. When the control valve is at its first position, the control fluid creates an hydraulic force which moves the check valve to a closed position. When the control valve is at its second position, the control fluid moves the check valve to an open position to allow the pressurized fuel to be ejected from the nozzle opening(s). The intensifier can also be hydraulically controlled by a control valve. The fuel injector does not contain or utilize any mechanical return springs. The absence of such springs increases the durability and performance repeatability of the injector. Additionally, the positions of the check valve and the intensifier can be rapidly changed by the hydraulic forces of the control fluid to provide a high speed fuel injector.

Figure 1:
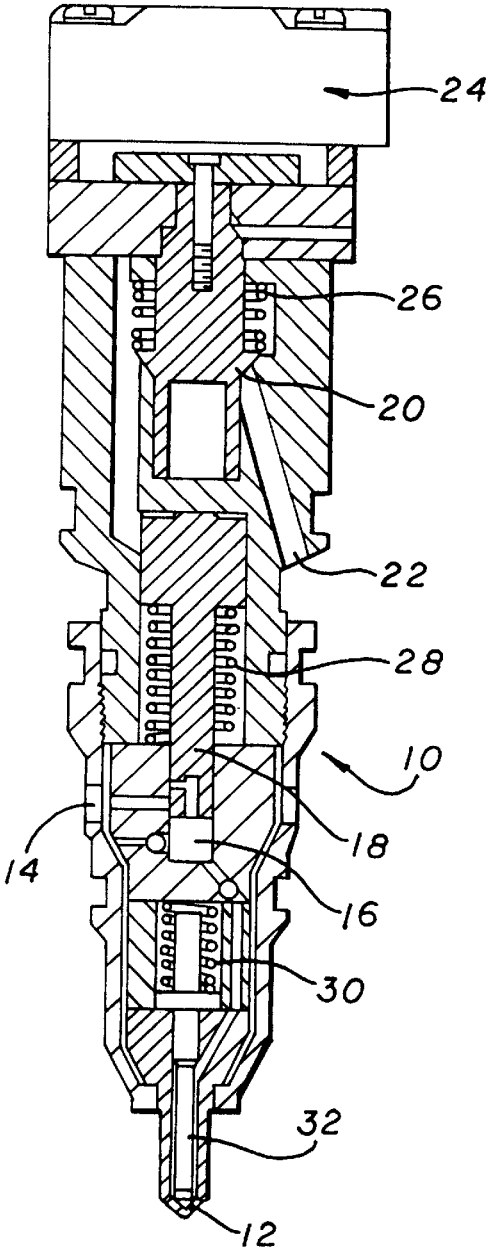
FIG. 1 PRIOR ART
FIG. 1 is a cross-sectional view of a fuel injector of the prior art.
Figure 2:
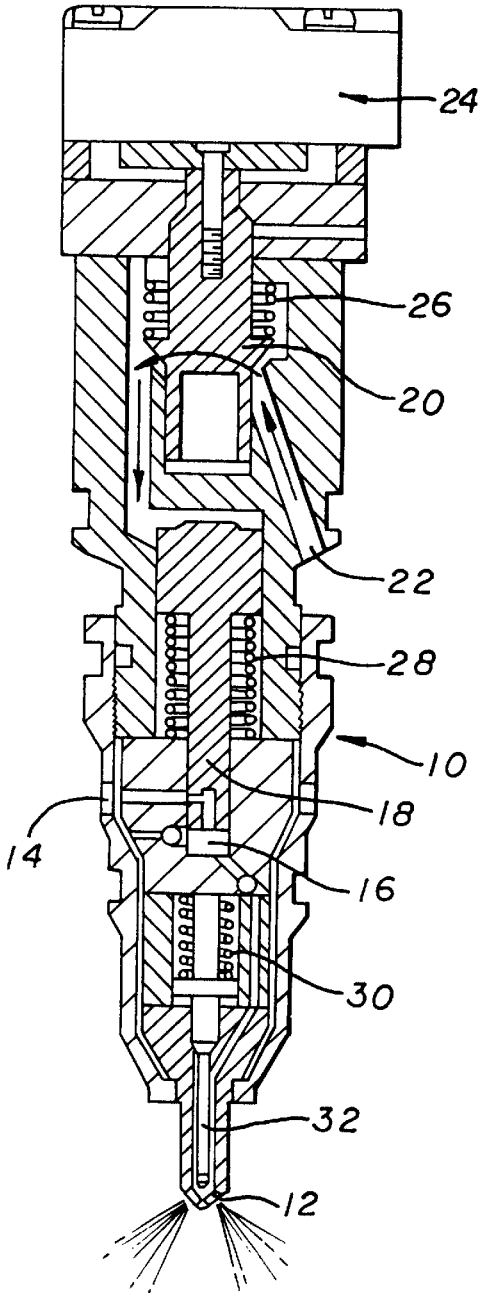
FIG. 2 PRIOR ART
FIG. 2 is a cross-sectional view of the prior art fuel injector ejecting fuel.
Figure 3:
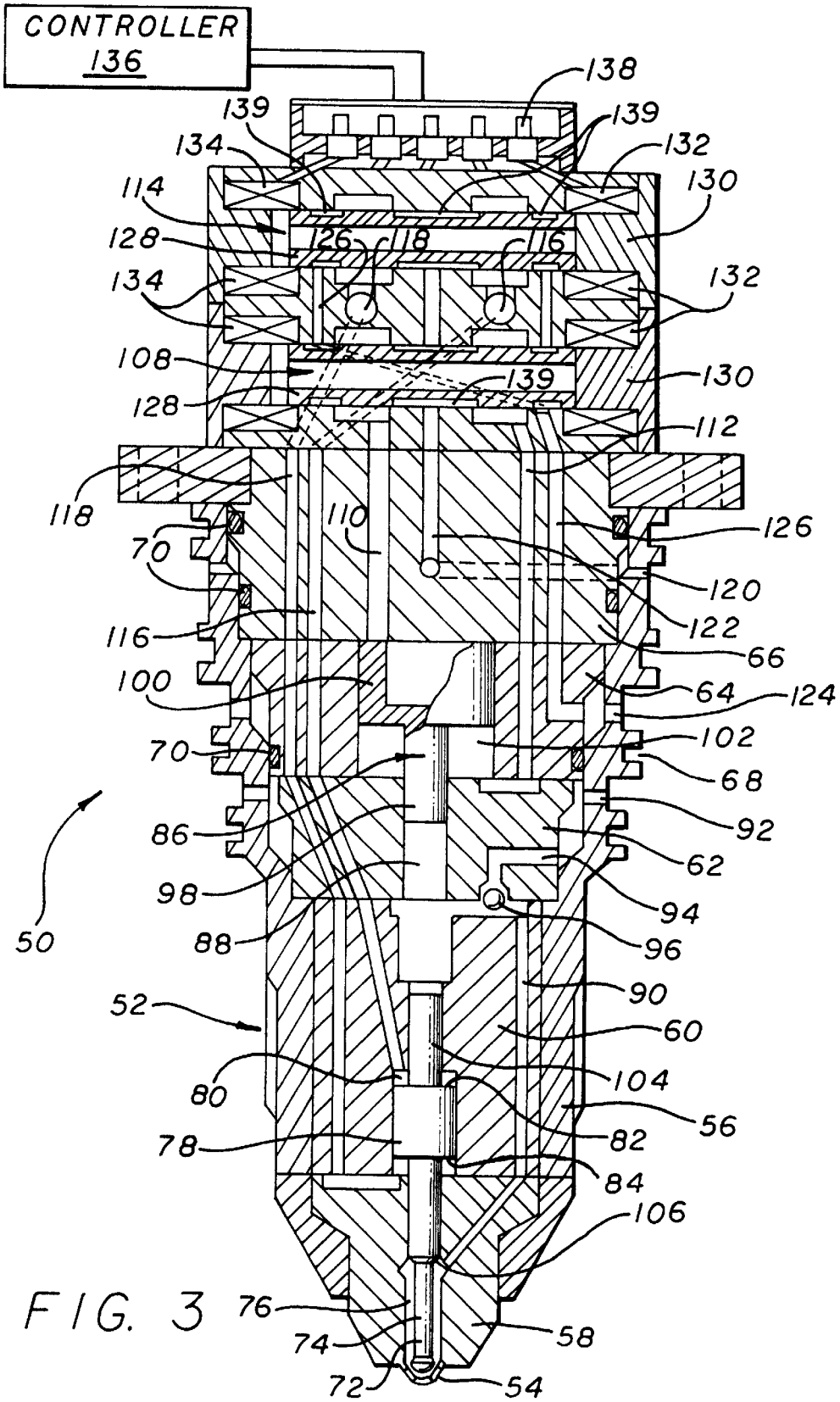
FIG. 3 is a cross-sectional view of an embodiment of a fuel injector of the present invention.

Referring to the drawings more particularly by reference numbers, FIG. 3 shows an embodiment of a fuel injector 50 of the present invention. The injector 50 may include a valve body 52 which has at least one nozzle opening or fuel spray orifice 54. The valve body 52 may include an outer shell 56 which supports a nozzle tip 58, a piston block or spacer 60, a pair of intensifier blocks or spacers 62 and 64 and a manifold block 66. The valve body 52 may be attached to an engine cylinder head (not shown) and extend directly into an internal combustion chamber (not shown). The shell 56 may have a number of outer circumferential grooves 68 that retain O-rings (not shown) which seal the injector 50 to the engine cylinder head. Additionally, the injector 50 may contain a number of internal O-rings 70 that seal the blocks 62, 64 and 66 to the shell 56.

The injector 50 may include a check or needle valve 72 that controls the flow of a fuel through the nozzle openings 54. The check valve 72 may have a needle portion 74 located within a nozzle chamber 76 of block 58 and a piston portion 78 located within a piston chamber 80 of block 60. The piston 78 and needle 74 may be two separate pieces or one integral piece.

The piston chamber 80 may receive a control fluid which exerts an hydraulic force on either a first surface 82 of the piston 78 or a second surface 84 of the piston 78. An hydraulic force exerted on the first surface 82 moves the check valve 72 to a closed position where it seats against the nozzle tip 58 and prevents fuel from being ejected from the injector 50. An hydraulic force exerted on the second surface 84 moves the check valve 72 to an open position and allows fuel to flow through the nozzle openings 54.

The injector 50 may include an intensifier 86 which pressurizes a fuel located within a fuel chamber 88. The fuel chamber 88 communicates with the nozzle chamber 76 by a passage 90. The fuel chamber 88 may also communicate with a fuel inlet port 92 by passage 94. The passage 94 may contain a inlet check valve 96 which prevents a reverse flow of fuel out through the inlet port 92.

The intensifier 86 has a piston portion 98 located within the fuel chamber 88 and a head portion 100 located within an intensifier chamber 102. The head portion 100 has an effective surface area that is larger than an effective surface area of the piston 98. The differential area provides a mechanical gain so that an hydraulic force exerted on the head 100 will move the intensifier 86 from a first position to a second position and pressurize the fuel within the fuel chamber 88.

The injector 50 may include a balance pin 104 that communicates with the fuel chamber 88 and the piston 78 of the check valve 72. The pressure of the fuel on the pin 104 offsets the hydraulic force exerted by the fuel onto a shoulder 106 of the needle 74 to balance the check valve 72 so that movement of the check valve 72 is controlled by the net hydraulic force on the piston 78.

The movement of the intensifier 86 may be controlled by a first control valve 108 that communicates with the intensifier chamber 102 by passages 110 and 112. The movement of the check valve 72 may be controlled by a second control valve 114 that communicates with the piston chamber 80 by passages 116 and 118. The control valves 108 and 114 may both communicate with a supply port 120 by a passage 122 and a return port 124 by a passage 126. The supply port 120 may communicate with a rail line (not shown) of an engine which has a pressurized control fluid. The rail line typically communicates with the output of a pump. The control fluid may be the fuel or a separate hydraulic fluid. The return port 124 typically communicates with a drain line which has a relatively low pressure.

Each valve 108 and 114 may have a spool 128 that reciprocally moves within a valve housing 130 between a first position and a second position. Each valve 108 and 114 may also have coils 132 and 134 that are coupled to an electrical controller 136 through terminals 138. The controller 136 selectively provides an electrical current to one of the coils 132 and 134. The current creates a magnetic field which pulls the spool 128 towards one of the positions.

The spool 128 and housing 130 are preferably constructed from 4140 steel which will retain a residual magnetism that is strong enough to maintain the position of the spool 128 even when electrical current is no longer provided to the coils 132 and 134. In this manner, the controller 136 can switch the state of the valves 108 and 114 with a digital pulse. The control valves 108 and 114 may be similar to the valves disclosed in U.S. Pat. No. 5,640,987 issued to Sturman, which is hereby incorporated by reference.

The spools 128 preferably have outer grooves 139 which create a four-way valve. When the spool 128 of the first valve 108 is at its the first (e.g. rightward) position, the outer grooves 139 provide fluid communication between passage 112 and the supply port 120, and fluid communication between the passage 110 and the return port 124 to force the intensifier 86 to its first position. When the spool 128 of the first valve 108 is at its second (e.g. leftward) position, the passage 110 is in fluid communication with the supply port 120 and the passage 112 is in fluid communication with the return port 124 so that the intensifier 86 is moved to its second position to pressurize the fuel.

When the spool 128 of the second control valve 114 is at its first position, the passage 116 is in fluid communication with the supply port 120 and the passage 118 is in fluid communication with the return port 120 so that the check valve 72 is pushed into the closed position. When the spool 128 of the second control valve 114 is at its second position the passage 116 is in fluid communication with the return port 124 and the passage 118 is in fluid communication with the supply port 120 so that the check valve 72 is moved to its open position.

Figure 4:
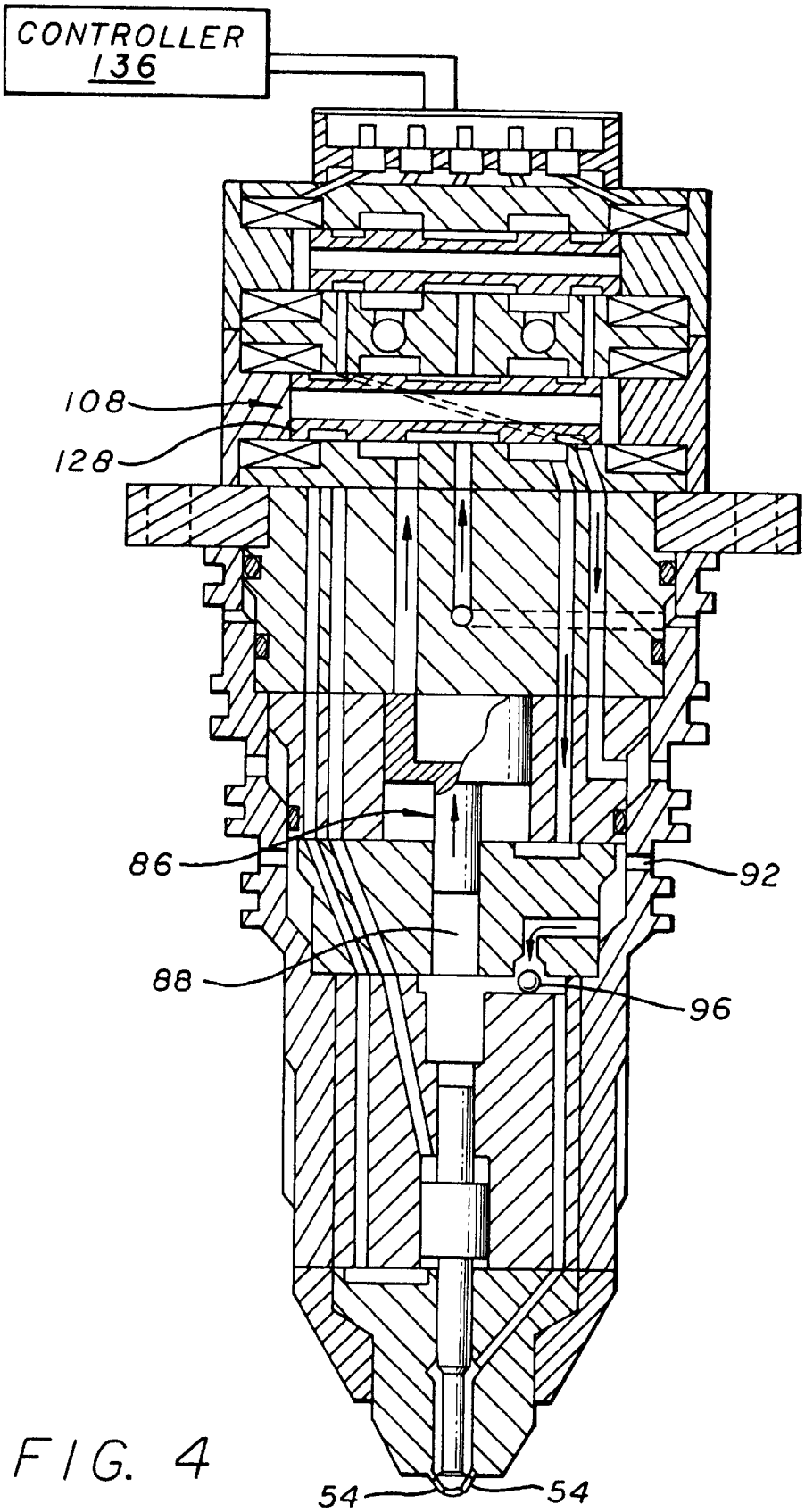
FIG. 4 is a view similar to FIG. 3 showing the fuel injector drawing in fuel.

As shown in FIG. 4, in operation, the spool 128 of the first control valve 108 is switched from its second position to its first position to move the intensifier 86 from its second position to its first position. The (e.g. upward) movement of the intensifier 86 expands the fuel chamber 88 and draws in fuel through the inlet port 92 and the check valve 96. The spool 128 of the first control valve 108 is typically maintained at its closed position to prevent fuel from flowing through the nozzle opening 54.

Figure 5:
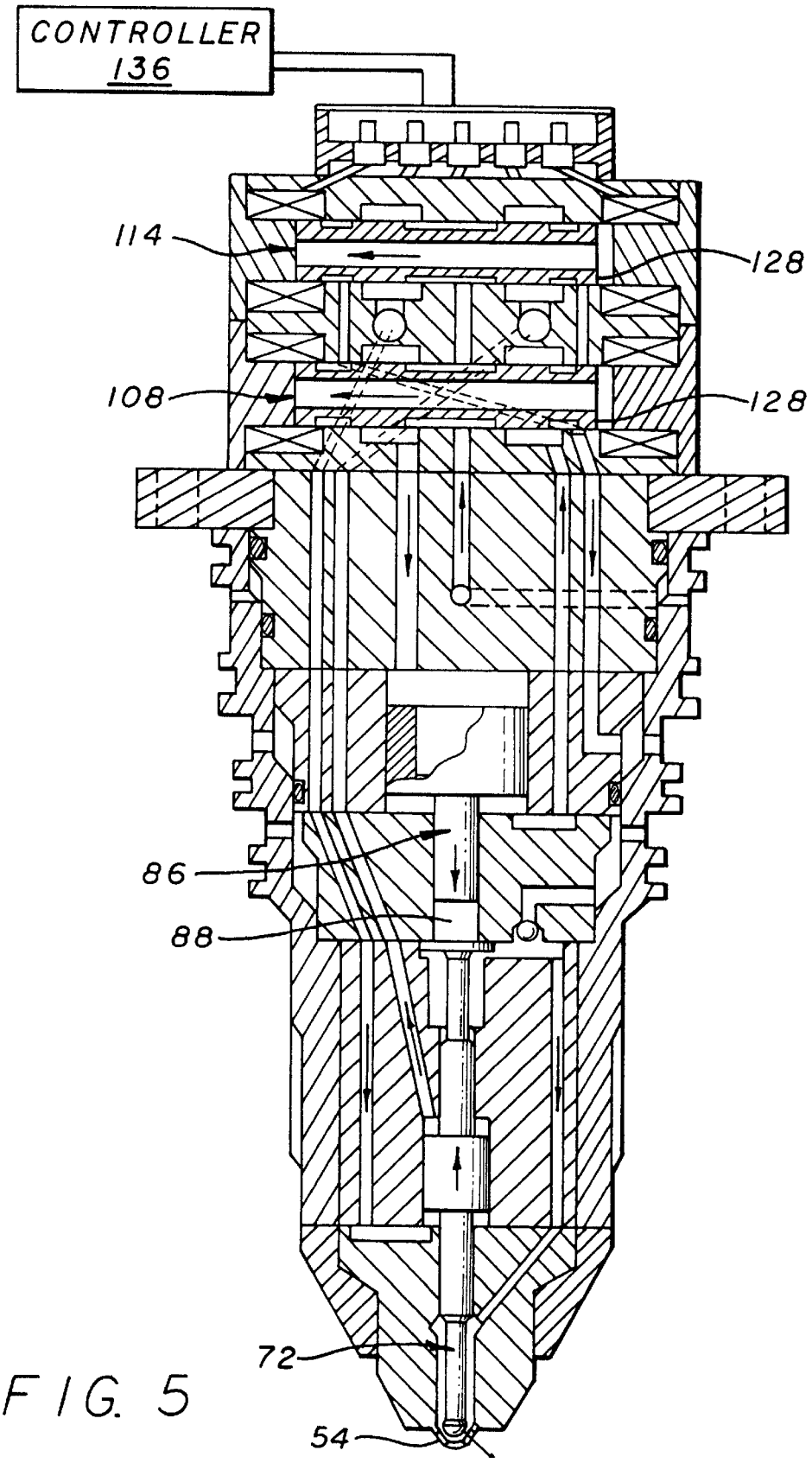
FIG. 5 is a view similar to FIG. 3 showing the fuel injector ejecting the fuel.

As shown in FIG. 5, to eject or spray fuel from the injector 50, the spool 128 of the second control valve 114 is switched from its first position to its second position. The intensifier 86 is moved to its second (e.g. downward) position to pressurize the fuel within the fuel chamber 88. The check valve 72 is moved to its open position to allow the pressurized fuel to flow through the nozzle opening(s) 54. The spool 128 of the respective control valves 108 and 114 are then switched to their respective first positions and the cycle is repeated.

Figure 6:
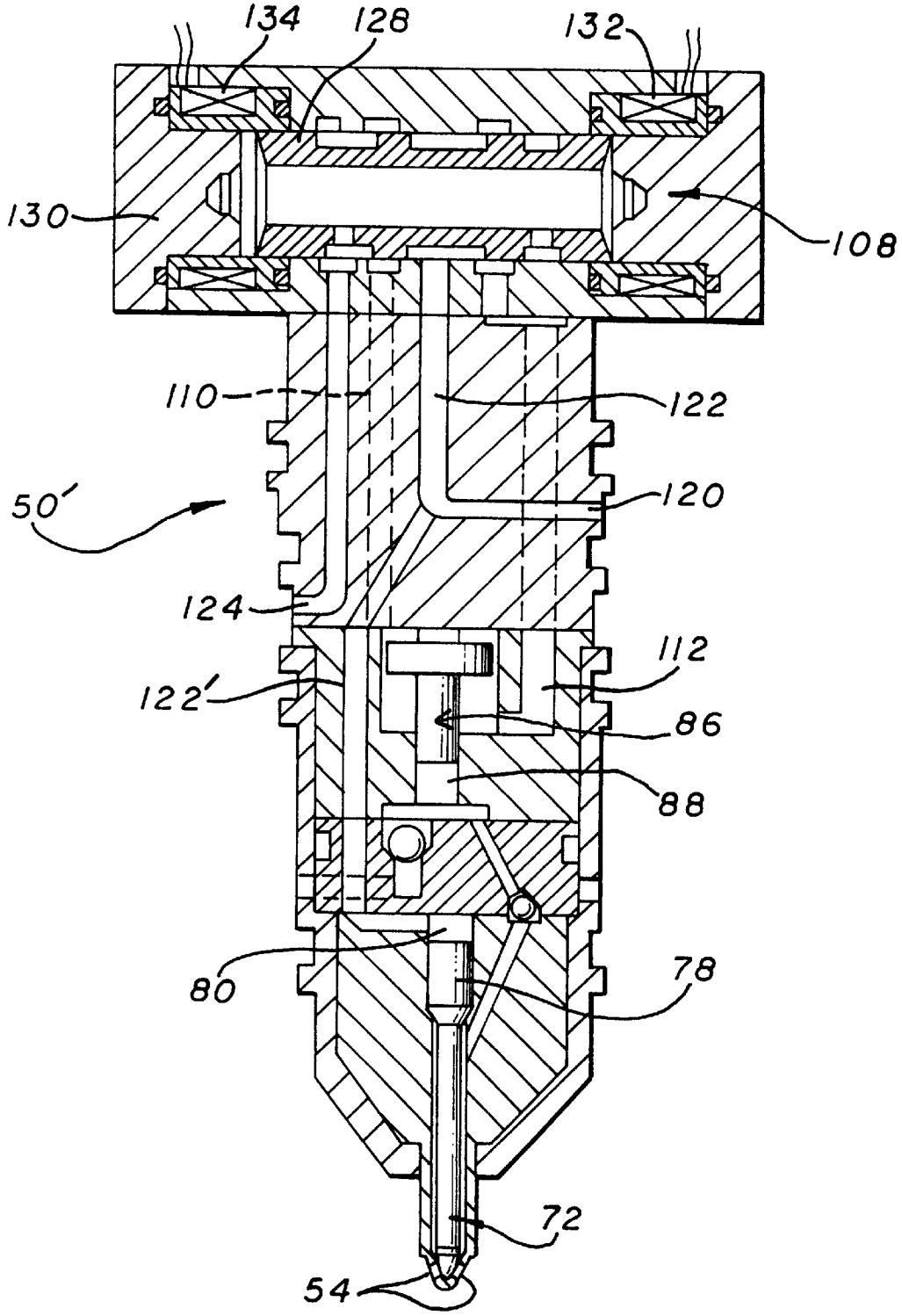
FIG. 6 is a cross-sectional view of an alternate embodiment of the fuel injector.

FIG. 6 shows an alternate embodiment of a fuel injector 50'. In this embodiment the supply passage 122 communicates with the piston chamber 80 by passage 122'. The check valve 72 is biased towards its closed position by the effective pressure of the control fluid in the piston chamber 80. When the intensifier 86 is moved to its second position, the pressure of the fuel is much greater than the pressure of the control fluid, so that the fuel pressure pushes the check valve 72 away from the nozzle opening(s) 54. When the intensifier 86 returns to its first position (e.g. upward), the pressure of the fuel drops and the pressure of the working fluid within the passage 122' moves the check valve 78 and closes the nozzle 54.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A fuel injector, comprising:

a valve body having a fuel chamber that is in a first fluid communication with at least one nozzle opening;

an intensifier in a second fluid communication with a source of a control fluid, said intensifier moving within said valve body between a first position and a second position when said control fluid is directed to said intensifier, said intensifier operable to pressurize fuel within said fuel chamber when moved from its first position to its second position; and, an hydraulically controlled check valve in a third fluid communication with the source of control fluid, said check valve movable within said valve body between an open position and a closed position, said check valve operable to allow the fuel to flow from said fuel chamber through said nozzle opening when in said open position and to close said nozzle opening when in said closed position.

2. The fuel injector of claim 1, further comprising a control valve movable between a first position and a second position, said control valve operable to allow control fluid to move said check valve into said closed position when in said first position and move said check valve into said open position when in said second position.

3. The fuel injector of claim 2, wherein said control valve is a four-way valve.

4. The fuel injector of claim 1, further comprising a balance pin that is arranged in third communication with said check valve and said fuel chamber.

5. A fuel injector, comprising:

a valve body having a fuel chamber that is in a first fluid communication with at least one nozzle opening;

an intensifier in a second fluid communication with a source of a control fluid, said intensifier moving within said valve body between a first position and a second position, said intensifier operable to pressurize fuel within said fuel chamber when moved from said first position to said second position;

a first control valve movable between a first position and a second position, said first control valve operable to allow said control fluid to move said intensifier into said first position when said first control valve is at said first position and move said intensifier into said second position when said first control valve is at said second position;

a check valve in a third fluid communication with the source of control fluid said check valve movable within said valve body between an open position and a closed position, said check valve operable to allow the fuel to flow from said fuel chamber through said nozzle opening when in said open position and to close said nozzle opening when in said closed position; and, a second control valve movable between a first position and a second position, said second control valve operable to allow control fluid to move said check valve into said closed position when in said first position and move said check valve into said open position when in said second position.

6. The fuel injector of claim 5, wherein said first and second control valves are each a four-way valve.

7. The fuel injector of claim 5, further comprising a balance pin that is arranged in fluid communication with said check valve and said fuel chamber.

8. A fuel injector, comprising:

valve body defining a fuel inlet port to receive fuel, a supply port to receive a pressurized control fluid, and a fuel chamber with a nozzle opening to provide a fuel spray;

an intensifier coupled to the fuel inlet port, the supply port, and the fuel chamber, the intensifier including a piston portion and a head portion, positioned in the valve body and being movable between a retracted position and an advanced position, the head portion having an upper end exposed to the pressurized control fluid to move the intensifier toward the advanced position, the intensifier providing pressurized fuel to the fuel chamber by moving toward the advanced position; and a check valve, the check valve positioned in the valve body and being movable between an inject position in which the nozzle opening is open to provide the fuel spray, and a closed position in which the nozzle opening is blocked preventing the fuel spray, the check valve having a first surface exposed to the pressurized control fluid to move the check valve toward the closed position.

9. The fuel injector of claim 8, further comprising a control valve coupled to receive the pressurized control fluid and movable between a first position and a second position, the control valve in the first position exposing the first surface of the check valve to the pressurized control fluid.

10. The fuel injector of claim 9, wherein the check valve further has a second surface exposed to the pressurized control fluid to move the check valve toward the open position, the control valve in the second position exposing the second surface of the check valve to the pressurized control fluid.

11. The fuel injector of claim 10, wherein the control valve is a four-way valve, the control valve further coupled to a drain line, the control valve in the first position exposing the second surface of the check valve to the drain line, the control valve in the second position exposing the first surface of the check valve to the drain line.

12. The fuel injector of claim 8, further comprising a balance pin coupled to the check valve, the balance pin having an upper end exposed to the pressurized fuel, the upper end of the balance pin having an area substantially equal to the area of an opposing surface of the check valve exposed to the pressurized fuel in the fuel chamber.

13. A fuel injector comprising:

a valve body defining a nozzle opening and a supply port to receive a control fluid;

an intensifier positioned in said valve body and being movable between a first position and a second position, and said intensifier having a head portion exposed to said control fluid; and a check valve positioned in said valve body and being movable between an open position in which said nozzle opening is open, and a closed position in which said nozzle opening is blocked, and said check valve having a first surface exposed to said control fluid.

14. The fuel injector of claim 13 wherein said valve body defines a fuel chamber that is open to said nozzle opening when said check valve is in said open position and said intensifier includes a piston portion, said piston portion positioned in said plunger bore with one end in contact with said head portion and being movable with said head portion between said first position and said second position.

15. The fuel injector of claim 13 wherein said head portion has a lower end exposed to said control fluid.

16. A method of operating a fuel injector, comprising:

providing a pressurized control fluid;

directing the pressurized control fluid to an upper end of an intensifier to move the intensifier toward an advanced position, the intensifier providing pressurized fuel to a fuel chamber by moving toward the advanced position;

directing the pressurized control fluid to a first surface of a check valve to move the check valve toward a closed position to close a nozzle opening in the fuel chamber.

17. The method of claim 16, further comprising:

providing the pressurized control fluid to a control valve coupled to receive the pressurized control fluid and movable between a first position and a second position;

placing the control valve in the first position to direct the pressurized control fluid to the first surface of the check valve.

18. The method of claim 17, further comprising placing the control valve in the second position to direct the pressurized control fluid to a second surface of the check valve to move the check valve toward an open position to open the nozzle opening in the fuel chamber.

19. The method of claim 18, wherein the control valve is a four-way valve, placing the control valve in the first position further exposes the second surface of the check valve to a drain line, and placing the control valve in the second position further exposes the first surface of the check valve to the drain line.

20. The method of claim 16, further comprising exposing an upper end of a balance pin coupled to the check valve to the pressurized fuel, the upper end of the balance pin having an area substantially equal to the area of an opposing surface of the check valve exposed to the pressurized fuel in the fuel chamber.

* * * * *